US010900635B2

(12) United States Patent
Zhou et al.

(10) Patent No.: US 10,900,635 B2
(45) Date of Patent: Jan. 26, 2021

(54) LIGHTING DEVICE

(71) Applicant: XIAMEN ECO LIGHTING CO. LTD., Xiamen (CN)

(72) Inventors: Yaling Zhou, Xiamen (CN); Xiaoming Yang, Xiamen (CN); Canchao Zhao, Xiamen (CN); Jianwei Lao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/944,765

(22) Filed: Apr. 3, 2018

(65) Prior Publication Data

US 2019/0301706 A1 Oct. 3, 2019

(51) Int. Cl.

| | |
|---|---|
| ***F21V 1/00*** | (2006.01) |
| ***F21V 5/04*** | (2006.01) |
| ***F21V 29/50*** | (2015.01) |
| ***F21S 8/04*** | (2006.01) |
| ***F21V 17/06*** | (2006.01) |
| *F21Y 115/10* | (2016.01) |

(52) U.S. Cl.

CPC ..... *F21V 5/04* (2013.01); *F21S 8/04* (2013.01); *F21V 17/06* (2013.01); *F21V 29/50* (2015.01); *F21Y 2115/10* (2016.08)

(58) Field of Classification Search

CPC .. F21S 8/02; F21S 8/026; F21V 5/007; F21V 17/02

See application file for complete search history.

(56) References Cited

U.S. PATENT DOCUMENTS

2007/0274081 A1* 11/2007 Engel ..... F21V 7/0016 362/346
2013/0077307 A1* 3/2013 Yamamoto ..... F21S 8/026 362/244
2013/0163254 A1* 6/2013 Chang ..... F21V 29/004 362/294
2013/0258672 A1* 10/2013 Bell ..... F21V 13/04 362/294
2014/0153250 A1* 6/2014 Matsushita ..... F21S 8/026 362/294
2015/0362159 A1* 12/2015 Ludyjan ..... F21V 23/06 362/277

FOREIGN PATENT DOCUMENTS

DE 102009060897 A1 * 7/2011 ..... F21S 8/026

* cited by examiner

*Primary Examiner* — Matthew J. Peerce
(74) *Attorney, Agent, or Firm* — Chun-Ming Shih; Lanway IPR Services

(57) ABSTRACT

A lighting device includes a prism plate, an anti-glare cup, a housing, a light source board, a heat dissipation assembly, and a lenses plate. The prism plate includes a refraction optical component. For example, make many micro-lenses on a surface of a transparent plastic material or a transparent plastic plate by compression molding, cutting, and injection molding. The combination of these optical lenses adjusts the beam angle of light to fulfill users' needs. The surface material of the anti-glare cup features on preventing visual glare. The housing is used to fasten the prism plate and the anti-glare cup. The light source board is for installation of a LED module. Besides, the heat dissipation assembly carries the light source board. The heat dissipation assembly is connected to the housing.

10 Claims, 3 Drawing Sheets

LIGHTING DEVICE

FIELD OF INVENTION

The present invention relates to a lighting device, and more particularly to a lighting device with adjustable lighting parameters.

BACKGROUND

Lighting is an important part of human life. Since Thomas Edison has invented electric lighting, the life of human being was widely changed. With the improvement in LED (Light emitting diode) technology and the decrease in cost, LED technology rapidly extends to various light fixtures and applications.

Compared with traditional incandescent light bulbs, LED usually has better luminous efficacy. However, LED components have limitations in heat resistance. If the problems of heat dissipation can be solved effectively, the life span of LED and the stability of light fixtures would be greatly improved.

LED can be applied to many different light fixtures, for example, a downlight is a quite common light fixture. Downlights are usually installed into a hollow opening in a ceiling or mounted in a housing placed in a hollow in a ceiling in advance. Downlights are usually used in common lighting occasions. However, with the increasing requirements of lighting, some downlights are designed to be with narrow beam angles, while some downlights are used to provide soft illumination. Although light emitted from all downlights is gathered by lenses, the beam angle often needs to be adjusted to the distance between the light source and the target area for illumination, or the height or characteristic of the target object for illumination. However, the existing downlights are usually extremely difficult to change the beam angles, and people should buy different types of downlight to fulfill different lighting needs.

This way of design often increases the inventory cost. Thus, if the technical problem as above could be solved, it not only makes a major contribution to lighting technology, but also increases the value of the products.

SUMMARY OF INVENTION

The present invention provides a lighting device according to the first embodiment. The lighting device includes a prism plate, an anti-glare cup, a housing, a light source board, a heat dissipation assembly, and a lenses plate.

The prism plate includes a refraction optical component, e.g., creating many micro-lenses on a surface of a transparent plastic material or a transparent plastic plate by compression molding, cutting, and injection molding. The combination of these optical lenses adjusts the beam angle of light to fulfill users' needs.

The surface material of the anti-glare cup features on preventing visual glare. The housing is used to fasten the prism plate and the anti-glare cup. The light source board is for installation of a LED module.

Besides, the heat dissipation assembly carries the light source board. The heat dissipation assembly is connected to the housing.

The lenses plate includes lenses facing the LED module of the light source board. The light emitted from the LED module, after passing through the lenses plate, appears to be a lens beam.

Then, the lens beam passing through the refraction optical component of the prism plate converts to a light beam. The light beam includes a main beam angle. The main beam angle is determined by the optical refractive index of the prism plate.

With this design, once a user needs a downlight with a different beam angle, he just needs to exchange the prism plate for a different type of prism plate, and the downlight emits light with a different beam angle. Because the prism plate is fixed by the housing, the exchange of the prism plate only needs to take the housing apart.

This design not only improves the flexibility of a downlight, but also reduces the stocks. Downlights with different beam angles can be produced in large numbers by the same molds, then install corresponding prism plates to produce different downlights.

In some embodiments, the main beam angle is changed by exchanging the prism plate for another prism plate with different optical refractive index.

In some embodiments, the prism plate contains close arrays of multiple micro-lenses formed on the surface.

In some embodiments, to fix the prism plate, one side of the prism plate is fastened to the anti-glare cup, and the opposite side of the prism plate is fastened to the inner hoop of the housing.

In some embodiments, the inner surface of the inner hoop contains a surface good for reflecting light. For example, paint the inner surface of the inner hoop, or choose a material with great reflective property such as white PC (Polycarbonate) materials.

In some embodiments, the inner surface of the inner hoop contains a white coating used to reflect light.

In some embodiments, the anti-glare cup contains a removable fastener used to keep a removable connection to the housing. After remove the anti-glare cup from the housing, the prism plate is able to be separated from the housing, the prism plate is able to be changed to accomplish the object of changing the main beam angle.

In some embodiments, the anti-glare cup is rotated relative to the housing, the removable fastener of the anti-glare cup is fastened on the housing in the first direction, and loosened in the second direction.

In some embodiments, the anti-glare cup contains a tapered slot. The anti-glare cup is rotated along the tapered slot to be fixed to the pillar of the housing.

In some embodiments, the LED modules of the light source board are scattered over the light source board to avoid heat concentration. The lenses of the lenses plate are placed in positions corresponding to each LED module to produce collimated light emitted from the LED modules.

In some embodiments, the lenses of the lenses plate in two opposite sides corresponding to the LED module are biconvex.

In some embodiments, the lenses plate may be composed of multiple pieces. The pieces of the lenses plate may have holes for heat dissipation. The pieces of the lenses plate are used to fix to the housing and the light source board to ensure that the lenses plate is firmly attached.

In some embodiments, the surface plate of the housing is fixed to the heat dissipation assembly.

According to another embodiment, the present invention provides a downlight easy to change beam angles. The downlight includes a light source board, a first optical assembly, a second optical assembly, and a container.

The light source board supports multiple LED modules. The multiple LED modules are scattered over the light source board. The distance between two LED modules is more than five percent of the radius of the light source board.

The first side of the first optical assembly faces the LED modules. Light emitted from the LED modules of the light source board, after passing through the first optical assembly, appears to be parallel rays.

The second optical assembly receives the light passing through the first optical assembly and produces main rays. The main rays include a main beam angle.

The container is used to fix the light source board, the first optical assembly and the second optical assembly.

In some embodiments, the first optical assembly includes multiple lenses facing the LED modules.

In some embodiments, the second optical assembly includes multiple micro-lenses used to convert the incident rays into corresponding rays.

In some embodiments, the second optical assembly is fastened on the container by a clasp structure. The surface of clasp structure reduces the visual glare. The beam angles are changed by changing the second optical assembly.

In some embodiments, the anti-glare cup and the container clasp the second optical assembly.

In some embodiments, the container includes at least two springs used to fix the downlight to the ceiling.

In some embodiments, the downlight includes a heat dissipation assembly fixed to the light source board and the container.

According to the embodiments given above, the present invention provides a downlight or other types of lighting device with smaller size and simple replacement of beam angles. With this design, the production cost is decrease and the convenience and the flexibility of a lighting device are improved.

DETAILED DESCRIPTION

Figure 1:
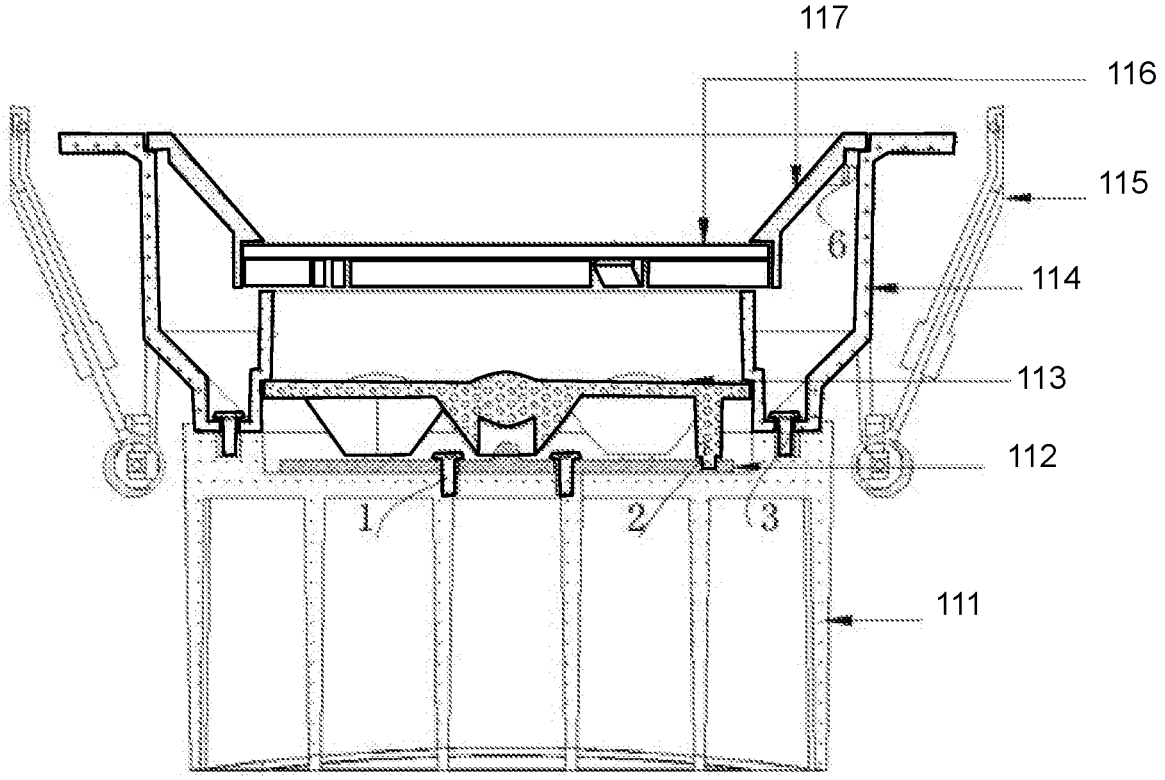
FIG. 1 illustrates an embodiment of a downlight.

Please refer to FIG. 1. The present invention provides a lighting device including a heat dissipation assembly 111, a light source board 112, a lenses plate 113, a trim 114, a spring 115, a prism plate 116, and an anti-glare cup 117.

This embodiment removes the cover, the rotatable frame pressing plate and the rotation shelf used in a traditional lighting device. The glass plate of a traditional lighting device is replaced with a prism plate. The prism plate is used to change the beam angle. The integrated circuit of a light source, packaged by cob (chip on board) packaging process, in a traditional lighting device is replaced with a distributed SMD (surface-mount device) light source. With the distributed SMD (surface-mount device) light source, the h heat dissipation of the lighting device is improved.

The heat dissipation assembly 111 and the light source board 112 is assembled by screws (position 1). The lenses plate 113 is provided with a locating pillar used to fix the lenses plate 113 to the light source board (position 2). The trim 114 is fastened on the heat dissipation assembly 111 by screws (position 3).

A cylindrical inner hoop is placed in the inner side of the trim 114 (position 4). The cylindrical inner hoop has three functions: compact the lenses plate from top; cover the screws in position 3; the cylindrical inner hoop contains a white high reflection coating, when light passes through the white high reflection coating, result in a high percentage of light being reflected, the light losses are decreased.

The anti-glare cup 117 is provided with two clasps used to assemble with the trim 114 and the prism plate 116.

Figure 2:
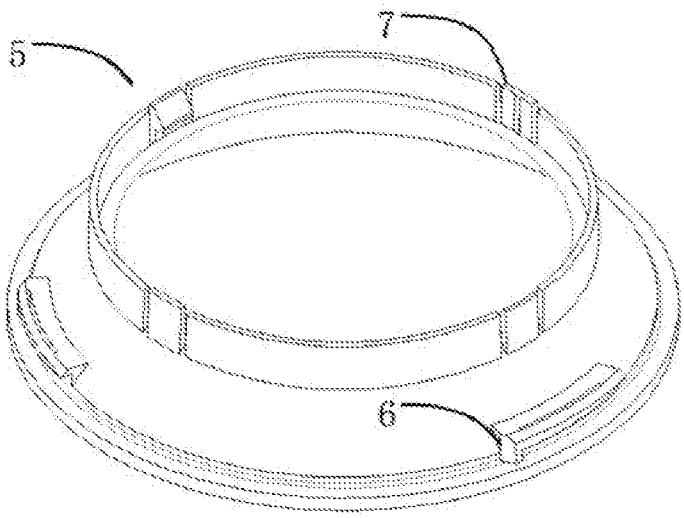
FIG. 2 illustrates an anti-glare cup used in an embodiment of a downlight.

Please refer to FIG. 2. FIG. 2 is a three-dimensional perspective view of an anti-glare cup 117 of FIG. 1. By the clasp (position 5) and the elasticity of the shaft (position 7), the prism plate 116 of FIG. 1 is fixed to the anti-glare cup 117 on the principle of interference fits. The block (position 6) is used to keep the assemblies.

Figure 3:
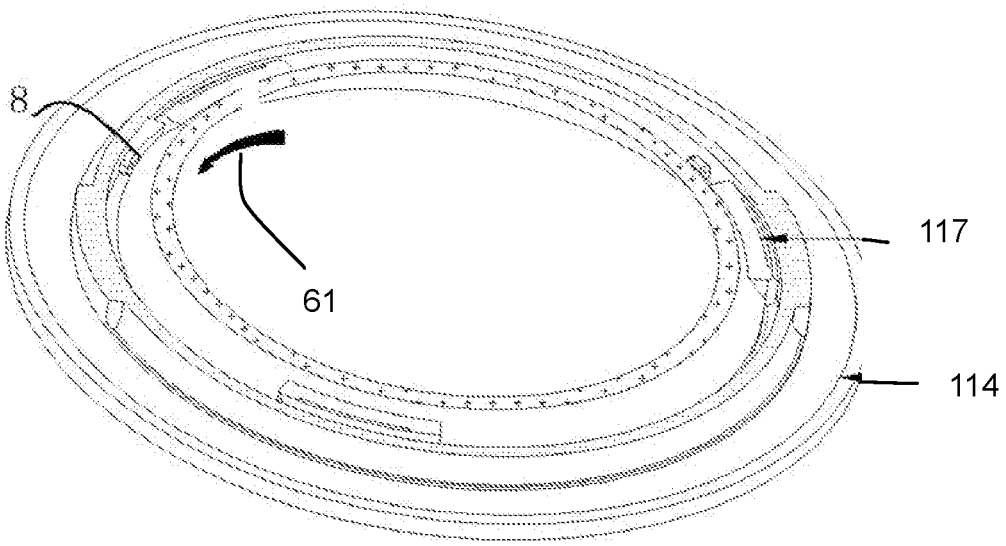
FIG. 3 illustrates a connection between a surface plate and an anti-glare cup with an example.

Please refer to FIG. 3. FIG. 3 is a partial cross-sectional view of the anti-glare cup 117 and the trim 114. The trim 114 is provided with a pillar (as shown in position 8 of FIG. 3). The anti-glare cup is provided with a tapered slot. When the anti-glare cup is rotated in the direction of the arrow 61 of FIG. 3, the slot does a relative motion to the pillar. Because the slot becomes gradually narrower at one end, the pillar is firmly attached to the slot.

This lighting device uses a lens to produce collimated light, then the collimated light passes through the prism plate with second adjustments. Different prism plates produce light with different beam angles. When the beam angle needs to be changed, just rotate the anti-glare cup in another direction to loosen the anti-glare cup and the prism plate. Then move the shaft towards outside to take the prism plate down, take on another desired prism plate.

The present invention provides a lighting device according to the first embodiment. The lighting device includes a prism plate, an anti-glare cup, a housing, a light source board, a heat dissipation assembly, and a lenses plate.

The prism plate includes a refraction optical component. For example, make many micro-lenses on a surface of a transparent plastic material or a transparent plastic plate by compression molding, cutting, and injection molding. The combination of these optical lenses adjusts the beam angle of light to fulfill users' needs.

The surface material of the anti-glare cup features on preventing visual glare. The housing is used to fasten the prism plate and the anti-glare cup. The light source board is for installation of a LED module.

Besides, the heat dissipation assembly carries the light source board. The heat dissipation assembly is connected to the housing.

The lenses plate includes lenses facing the LED module of the light source board. The light emitted from the LED module, after passing through the lenses plate, appears to be a lens beam.

Then, the lens beam passing through the refraction optical component of the prism plate converts to a light beam. The light beam includes a main beam angle. The main beam angle is determined by the optical refractive index of the prism plate.

With this design, once a user needs a downlight with a different beam angle, he just needs to exchange the prism plate for a different type of prism plate, and the downlight emits light with a different beam angle. Because the prism plate is fixed by the housing, the exchange of the prism plate only needs to take the housing apart.

This design not only improves the flexibility of a downlight, but also reduces the stocks. Downlights with different beam angles can be produced in large numbers by the same molds, then install corresponding prism plates to produce different downlights.

In some embodiments, the main beam angle is changed by exchanging the prism plate for another prism plate with different optical refractive index.

In some embodiments, the prism plate contains close arrays of multiple micro-lenses formed on the surface.

In some embodiments, to fix the prism plate, one side of the prism plate is fastened to the anti-glare cup, and the opposite side of the prism plate is fastened to the inner hoop of the housing.

In some embodiments, the inner surface of the inner hoop contains a surface good for reflecting light. For example, paint the inner surface of the inner hoop, or choose a material with great reflective property such as white PC materials.

In some embodiments, the inner surface of the inner hoop contains a white coating used to reflect light.

In some embodiments, the anti-glare cup contains a removable fastener used to keep a removable connection to the housing. After remove the anti-glare cup from the housing, the prism plate is able to be separated from the housing, the prism plate is able to be changed to accomplish the object of changing the main beam angle.

In some embodiments, the anti-glare cup is rotated relative to the housing, the removable fastener of the anti-glare cup is fastened on the housing in the first direction, and loosened in the second direction.

In some embodiments, the anti-glare cup contains a tapered slot. The anti-glare cup is rotated along the tapered slot to be fixed to the pillar of the housing.

In some embodiments, the LED modules of the light source board are scattered over the light source board to avoid heat concentration. The lenses of the lenses plate are placed in positions corresponding to each LED module to produce collimated light emitted from the LED modules.

In some embodiments, the lenses of the lenses plate in two opposite sides corresponding to the LED module are biconvex.

In some embodiments, the lenses plate may be composed of multiple pieces. The pieces of the lenses plate may have holes for heat dissipation. The pieces of the lenses plate are used to fix to the housing and the light source board to ensure that the lenses plate is firmly attached.

In some embodiments, the surface plate of the housing is fixed to the heat dissipation assembly.

According to another embodiment, the present invention provides a downlight easy to change beam angles. The downlight includes a light source board, a first optical assembly, a second optical assembly, and a container.

The light source board supports multiple LED modules. The multiple LED modules are scattered over the light source board. The distance between two LED modules is more than five percent of the radius of the light source board.

The first side of the first optical assembly faces the LED modules. Light emitted from the LED modules of the light source board, after passing through the first optical assembly, appears to be parallel rays.

The second optical assembly receives the light passing through the first optical assembly and produces main rays. The main rays include a main beam angle.

The container is used to fix the light source board, the first optical assembly and the second optical assembly.

In some embodiments, the first optical assembly includes multiple lenses facing the LED modules.

In some embodiments, the second optical assembly includes multiple micro-lenses used to convert the incident rays into corresponding rays.

In some embodiments, the second optical assembly is fastened on the container by a clasp structure. The surface of clasp structure reduces the visual glare. The beam angles are changed by changing the second optical assembly.

In some embodiments, the anti-glare cup and the container clasp the second optical assembly.

In some embodiments, the container includes at least two springs used to fix the downlight to the ceiling.

In some embodiments, the downlight includes a heat dissipation assembly fixed to the light source board and the container.

According to the embodiments given above, the present invention provides a downlight or other types of lighting device with smaller size and simple replacement of beam angles. With this design, the production cost is decrease and the convenience and the flexibility of a lighting device are improved.

In addition to embodiments as above, the present invention may have other applications or designs, and as long as they are within the spirit of the present invention, the various designs still belong to the scope of the present invention.

The invention claimed is:

1. A lighting device, comprising:

a prism plate, including a plane refraction optical component with multiple micro-lenses formed on a surface of the plane refractor optical component;

an anti-glare cup, wherein a surface material of anti-glare cup prevents visual glare;

a housing, wherein a housing is used to fasten the prism plate and the anti-glare cup;

a light source board, wherein a light source board is for installation of a LED module;

a heat dissipation assembly, wherein a heat dissipation assembly carries the light source board, the heat dissipation assembly is connected to the housing; and a lenses plate, wherein the lenses plate includes lenses facing the LED module of the light source board, the light emitted from the LED module, after passing through the lenses plate, forming a lens beam, then, the lens beam passing through the refraction optical component of the prism plate converts to a light beam directly outside the lighting device without passing through a further lens structure, the light beam includes a main beam angle, the main beam angle is determined by the optical refractive index of the prism plate, wherein the main beam angle is changed by exchanging the prism plate for another prism plate with different optical refractive index, wherein the anti-glare cup contains a removable fastener used to keep the anti-glare cup with a removable connection to the housing, after removing the anti-glare cup from the housing, the prism plate is able to be separated from the housing, the prism plate is able to be changed to accomplish the object of changing the main beam angle.

2. The lighting device of claim 1, wherein one side of the prism plate is fastened to the anti-glare cup, and the opposite side of the prism plate is fastened to the housing to fix the prism plate.

3. The lighting device of claim 2, wherein the inner surface of the inner hoop contains a surface good for reflecting light.

4. The lighting device of claim 3, wherein the inner surface of the inner hoop contains a white coating used to reflect light.

5. The lighting device of claim 2, wherein the anti-glare cup is rotated relative to the housing, and a removable fastener of the anti-glare cup is fastened on the housing in the first direction, and loosened in the second direction.

6. The lighting device of claim 2, wherein the anti-glare cup contains a tapered slot, the anti-glare cup is rotated along the tapered slot to fixed to the housing.

7. The lighting device of claim 1, wherein the LED modules of the light source board are scattered over the light source board to avoid heat concentration, the lenses of the lenses plate are placed in positions corresponding to each LED module to produce collimated light emitted from the LED modules.

8. The lighting device of claim 1, wherein the lenses of the lenses plate in two opposite sides corresponding to the LED module are biconvex.

9. The lighting device of claim 1, wherein the lenses plate is composed of multiple pieces, the pieces of the lenses plate have holes for heat dissipation, the pieces of the lenses plate fixed to the housing are used to fix to the housing and the light source board to ensure that the lenses plate is firmly attached.

10. The lighting device of claim 1, wherein a surface plate of the housing is fixed to the heat dissipation assembly.

* * * * *